US007013542B2

(12) United States Patent
Marrani et al.

(10) Patent No.: US 7,013,542 B2
(45) Date of Patent: Mar. 21, 2006

(54) PROCESS AND APPARATUS FOR THE TRANSFORMATION OF YARNS AND A YARN THUS PRODUCED

(75) Inventors: Pierluigi Marrani, Florence (IT); Solitario Nesti, Prato (IT); Marcello Barni, Prato (IT); Maurizio Poggiali, Prato (IT)

(73) Assignees: Unitech Textile Machinery S.p.A., Prato (IT); Pecci Filati S.p.A., Florence (IT)

( * ) Notice: Subject to any disclaimer, the term of this patent is extended or adjusted under 35 U.S.C. 154(b) by 0 days.

(21) Appl. No.: 10/802,295

(22) Filed: Mar. 17, 2004

(65) Prior Publication Data

US 2004/0216278 A1 Nov. 4, 2004

(30) Foreign Application Priority Data

Apr. 24, 2003 (IT) ..... FI2003A0116

(51) Int. Cl.
*D02J 3/02* (2006.01)

(52) U.S. Cl. ..... 28/247; 28/219

(58) Field of Classification Search ..... 28/217, 28/219, 246, 247, 248, 252, 253, 259, 258, 28/260, 162, 165, 220; 26/27, 28; 242/364.12, 242/522; 451/28, 242, 120, 140, 142, 143, 451/177, 199, 212; 57/2
See application file for complete search history.

(56) References Cited

U.S. PATENT DOCUMENTS

| | | | | | |
|---|---|---|---|---|---|
| 162,440 | A * | 4/1875 | Webber, Jr. | 451/183 |
| 1,957,508 | A * | 5/1934 | Taylor | 451/36 |
| 2,241,206 | A * | 5/1941 | Koster | 451/260 |
| 2,244,333 | A * | 6/1941 | Hanse | 451/183 |
| 2,273,752 | A * | 2/1942 | Frey | 451/182 |
| 2,278,879 | A * | 4/1942 | Hunter | 19/56 |
| 3,140,526 | A * | 7/1964 | Tlamicha | 451/54 |
| 3,431,716 | A * | 3/1969 | Mertens | 57/290 |
| 3,831,360 | A * | 8/1974 | Horvath | 57/2 |
| 3,949,041 | A * | 4/1976 | Schwarz | 264/168 |
| 5,034,250 | A * | 7/1991 | Guertin | 427/394 |
| 5,035,110 | A * | 7/1991 | Nelson | 57/208 |
| 5,081,753 | A * | 1/1992 | Fink et al. | 28/219 |
| 5,110,517 | A * | 5/1992 | Lukhard et al. | 264/40.1 |
| 5,392,499 | A * | 2/1995 | Bertoldo | 26/28 |
| 5,755,086 | A * | 5/1998 | Halbheer et al. | 57/351 |
| 5,802,832 | A * | 9/1998 | Foster | 57/264 |
| 5,956,828 | A * | 9/1999 | Chiou et al. | 28/219 |
| 6,269,525 | B1 * | 8/2001 | Dischler et al. | 26/28 |
| 2004/0107553 | A1 * | 6/2004 | Goineau et al. | 28/219 |

* cited by examiner

*Primary Examiner*—A. Vanatta
(74) *Attorney, Agent, or Firm*—McGlew & Tuttle PC

(57) ABSTRACT

Process for the mechanical transformation of a thread (F) of vegetable, animal or artificial or synthetic origin, characterized in that it includes abrading the thread (F) when the latter is supported in the air between two supports (55, 56).

19 Claims, 6 Drawing Sheets

PROCESS AND APPARATUS FOR THE TRANSFORMATION OF YARNS AND A YARN THUS PRODUCED

SPECIFICATION

The present invention refers to a process and an apparatus for the transformation of yarns and to a yarn thus produced.

BACKGROUND OF THE INVENTION

In particular, the invention refers to a process and an apparatus for changing the so-called "touch" and/or the structure of the yarn. One of the applications of the invention is to give the yarn an old or aged effect; however, further possible applications of the invention are not to be excluded.

It is known to execute finishing or upgrading treatments to clothing or other textile articles for obtaining said old or aged effect.

SUMMARY OF INVENTION

Among the main objects of the invention is that of giving the yarns of either vegetable or animal origin, as well as of artificial or synthetic nature, an aspect different from that exhibited beforehand, by means of deformations which affect the touch and/or the structure of the yarn.

This result has been achieved, according to the invention, by devising a process, an apparatus and a yarn having the characteristics described in the independent claims. Further characteristics being set forth in the dependent claims.

Among the advantages of the present invention, one is that it is possible to make yarns having special effects, by giving them an old appearances or the like, these effects being reproducible along the whole length of the yarn; that it is possible to treat yarns of different, such as animal, vegetable and artificial or synthetic, origin; that the process requires relatively moderated times; that it is possible to alter the characteristics of the effects being given, that is, to modify the intensity and frequency of such effects along the thread development; the yarns thus treated maintain their qualitative characteristics, that is, they do not undergo damages affecting their quality or mechanical resistance; that the apparatus in question keeps its characteristics unchanged even alter prolonged periods of use; that it is possible to reduce the production cost of the articles thus obtained by using yarns according to the invention, thereby avoiding or reducing the commonly performed finish or upgrading treatments.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE INVENTION

In general, a process according to the invention is a process for the mechanical transformation of yarns of vegetable, animal or artificial or synthetic origins, which provides for abrading the thread when the latter is supported in the air between two supports.

Advantageously, the thread may be fed continuously between the supports so as to carry out the abrasion throughout its development.

The yarn according to the invention have thread's portions, along its longitudinal development, which are subjected to a mechanical abrasive actions while it is suspended in the air between two supports.

Figure 1:
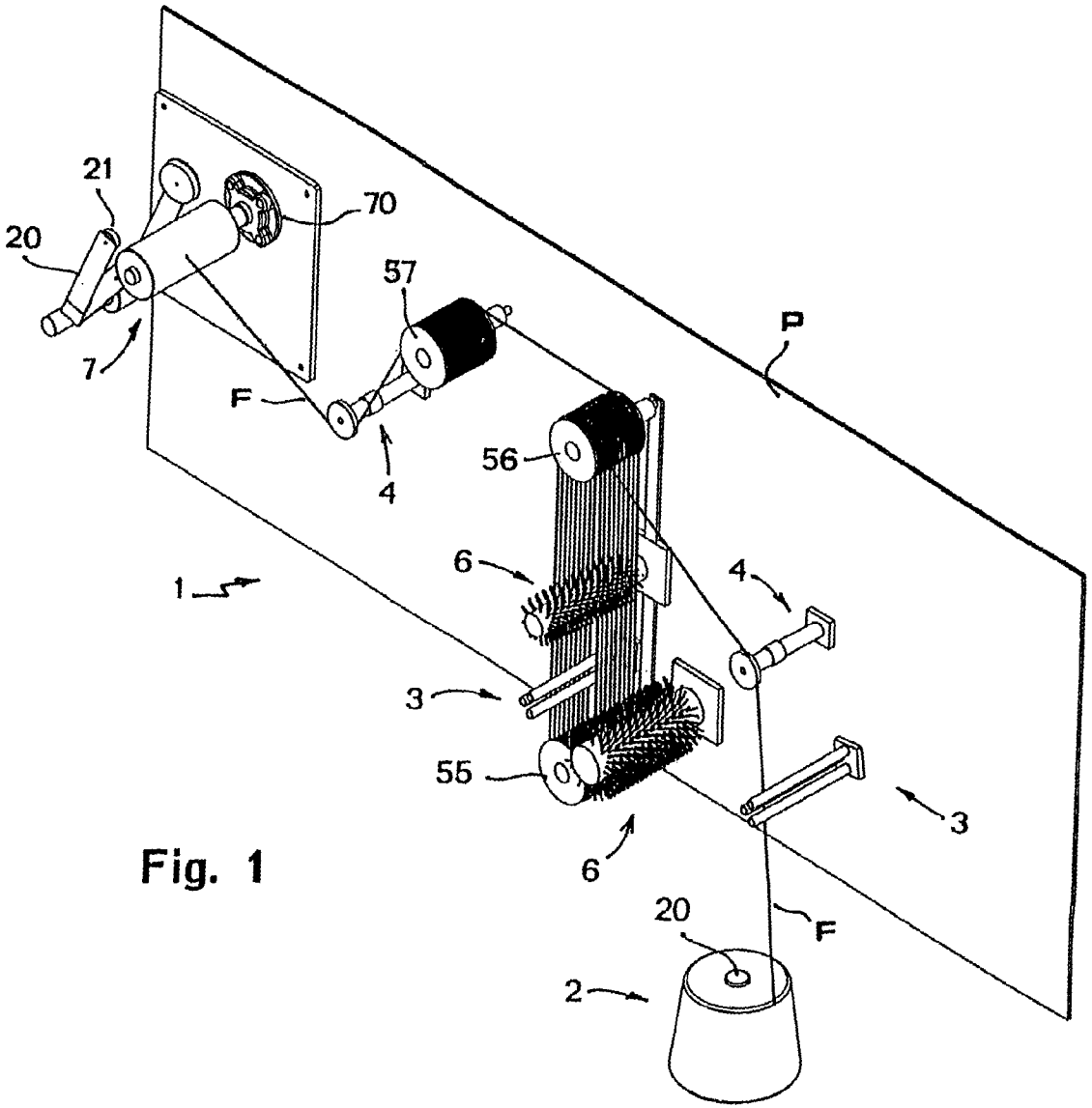
FIG. 1 is a schematic perspective view of a possible embodiment of an apparatus according to the present invention.

With reference to the figures of the accompanying drawings, numeral 1 in FIG. 1 designates an apparatus, according to the invention, which makes up a section of a plant; in practice, in a plant for treating the yarn according to the invention, more sections, like the one illustrated are provided in parallel relationship.

The apparatus 1 shown in FIG. 1 is provided with a support 20 having thereon a bobbin 2 to be unwound by a pull unit 7, with a collection motor 70 disposed downstream thereof. In other words, the bobbin 2 of thread F is acted upon with a "defilé" procedure. Downstream of the bobbin 2, the thread F goes through a thread-guide 3 provided with a friction-operated brake and, afterwards, through a sensor 4 which detects the thread's tension. The signal emitted by the sensor 4 (which may include a load cell or other suitable device) is advantageously used to act on the collection motor 70, that is, to maintain the thread's tension steady through the work. In the drawing, numeral 70 indicates, by way of example, a flange of the motor that may be also disposed on the non-viewable face P of the apparatus 1; besides, for exemplification purpose, only the support 20, 21 of the collecting bobbin has been represented and not the bobbing itself.

The two cylinders 55 and 56 are spaced apart by such an extension as to allow the interposition of an abrasive means 6 which, in the example, is represented by a brush. In particular, in the represented example, the thread F is subjected to the action of two brushes 6. The brushes operate on lengths suspended in the air, that is, without any supporting surface for the thread. The bristles of the brushes 6 do not operate with their free ends on the thread but with their relevant sides, and the same thread travels between the bristles of the brushes in order to be abraded.

At least one of the two cylinders 55, 56 is slotted to prevent the turns of the thread from becoming entangled and also to induce a revolution of the thread, so as to put all the thread's surface in contact with the brush. More driving-out units like the third cylinder 57, and thus more brushes, can be used according to the effect to be given to the fibre in the course of formation. For example, with very resistant and tough threads or fibres, such as those of the cotton, the abrasive action must result far more vigorous than with less resistant fibres like those of wool.

In FIG. 1, there are provided a second thread-guide 3 and a second sensor 4, with functions similar to their corresponding upstream-located devices, to improve the control of the thread's tension.

Figure 2:
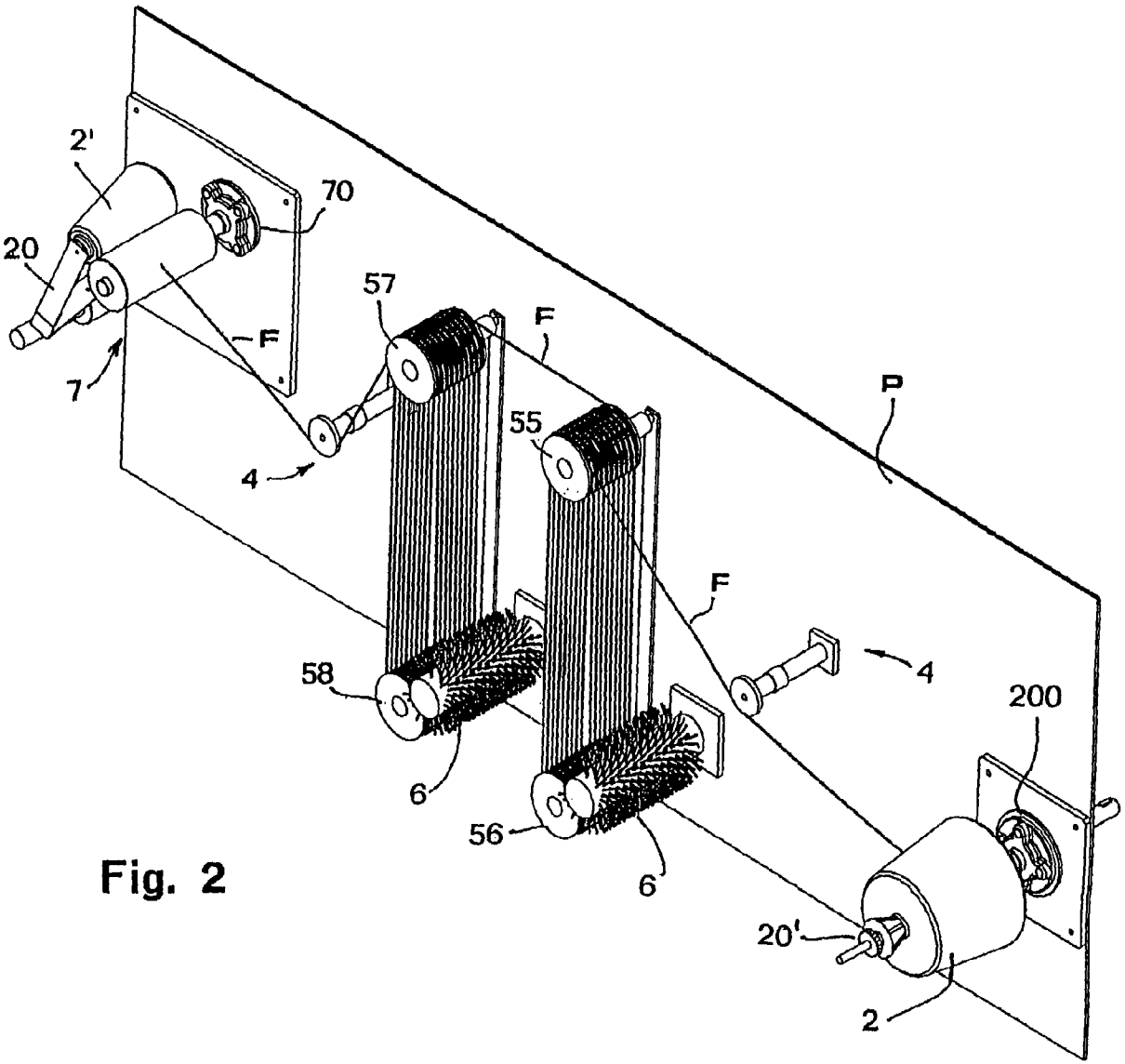
FIG. 2 is a schematic perspective view of a further possible embodiment of an apparatus according to the present invention.

In FIG. 2, the unwinding of the thread is of a type so-called "derulé", that is, one in which the bobbin 2 of the thread to be treated is supported by a shaft 20' driven by a relevant motor 200. The speed of the motor 200, and thus that of the motor 70 of the pulling unit 7, is controlled on the basis of the detections operated by the tension sensors 4; an accurate control is thus obtained of the amount of thread being unwound. The detections used for the control of the tension and/or unwind speed of the thread can be stored to provide statistics and/or data bases for subsequent operations. To this end, the sensors 4, motors 70 and 200, as well as other detection means, will be connected to electronic processing means such as a computer with the provision of data filing/storing means. The filed data can be used for automatically associating any type of thread with parameters such as tension, unwind speed, number of abrasive means, and procedures for interaction of these parameters with the thread, etc., according to the final result to be achieved.

In the example shown in FIG. 2, in addition to the first pair of cylinders 55 and 56, which define e first length of the thread on which a first brush 6 is made to act, provision is made for a second pair of cylinders 57 and 58 which define, in turns, a second length on which a second brush 6 operates. Downstream of the second pair of cylinders 57 and 58, after having gone through the second sensor 4, the thread is collected, for example with the aid of a slotted cylinder of conventional type, onto the bobbin 2' borne by the support 20 of the collection unit 7.

For example, the bristles 61 of brushes 6 may be made from abrasive nylon produced by-the Dupont Co.

Figure 3:
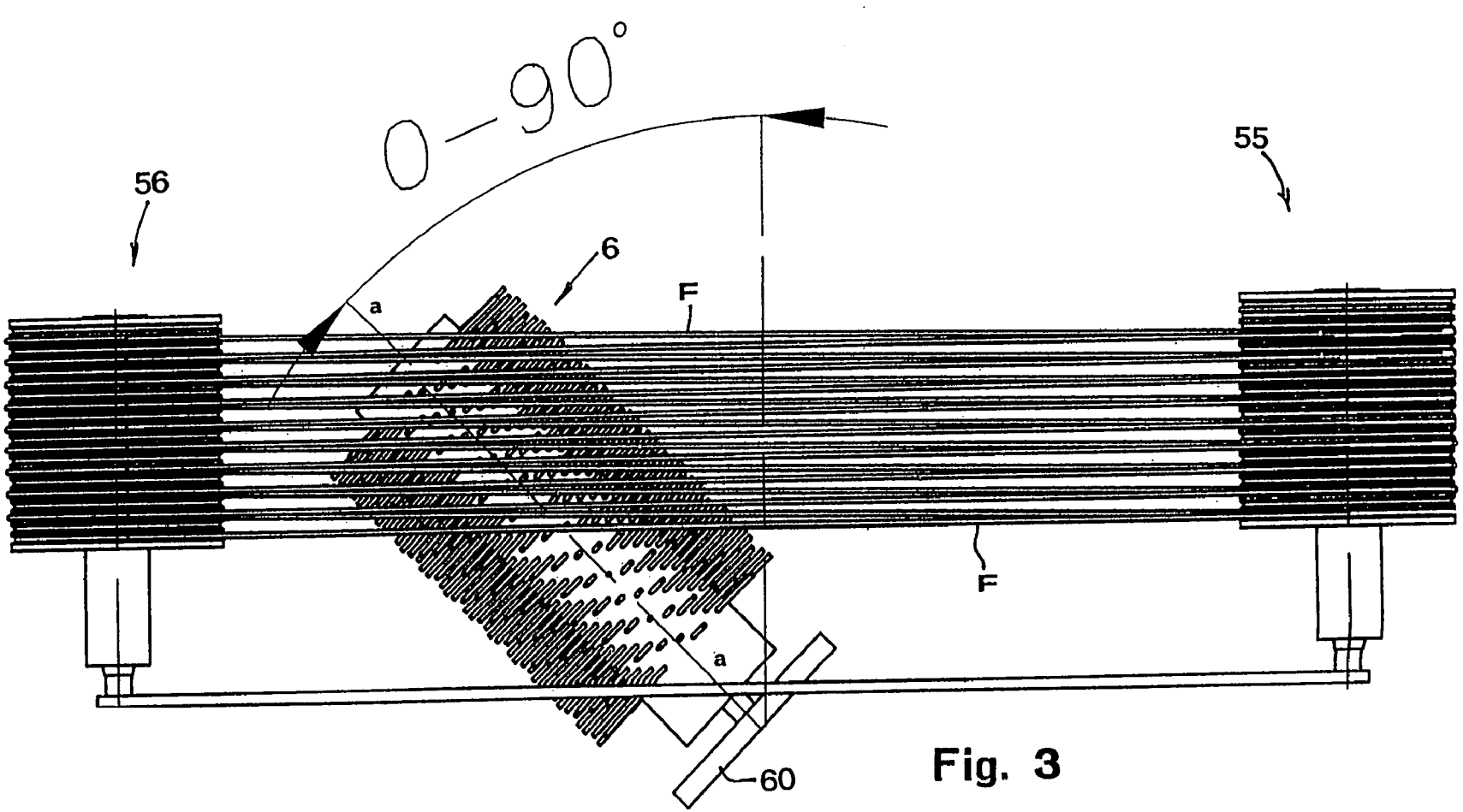
FIGS. 3 and 4 are side views of possible embodiments of abrasive means to be used according to the invention.
Figure 5B:
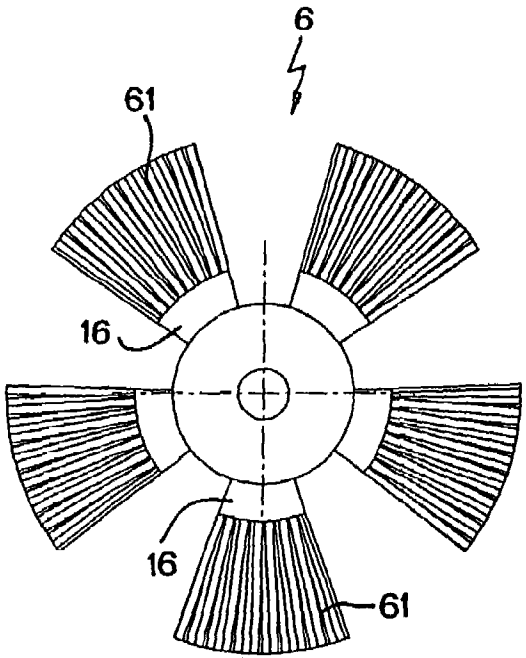
FIGS. 5A and 5B show, respectively, a side view and a front view of abrasive means according to the invention.
Figure 5A:
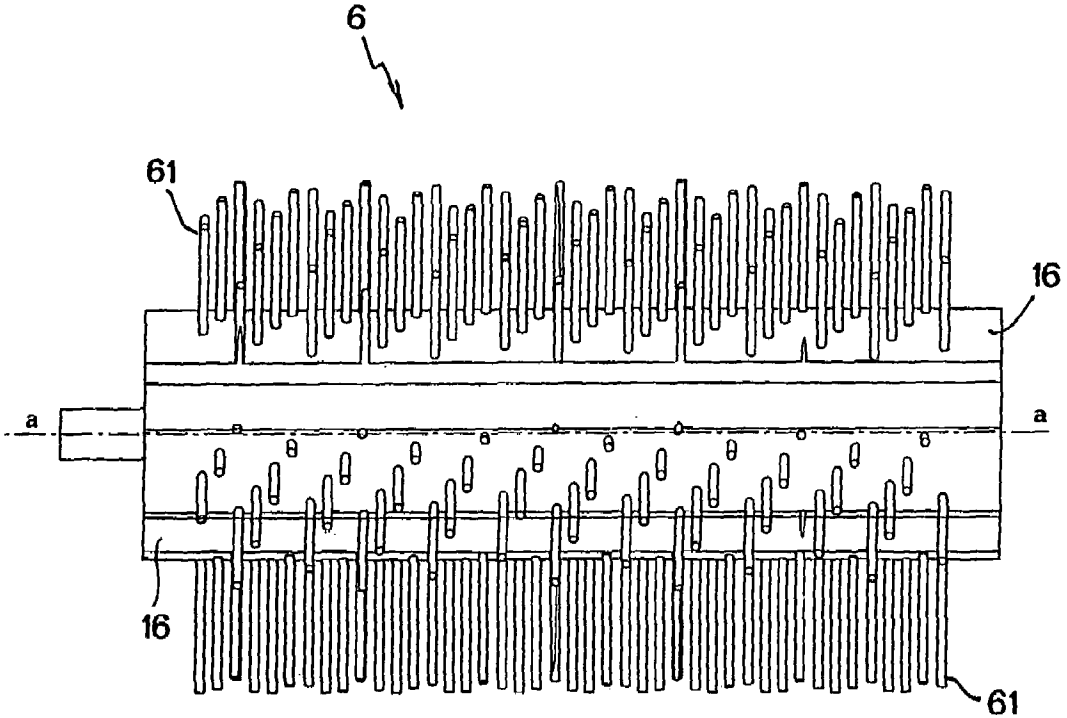

The brush's bristles may be disposed uniformly, as in the examples of FIGS. 1—3, or discontinuously as in the example of FIGS. 5A and 5B, in which the brush 6 consists of staves 16 parallel to the axis of the brush and on which the bristles 61 are fixed.

Figure 4:
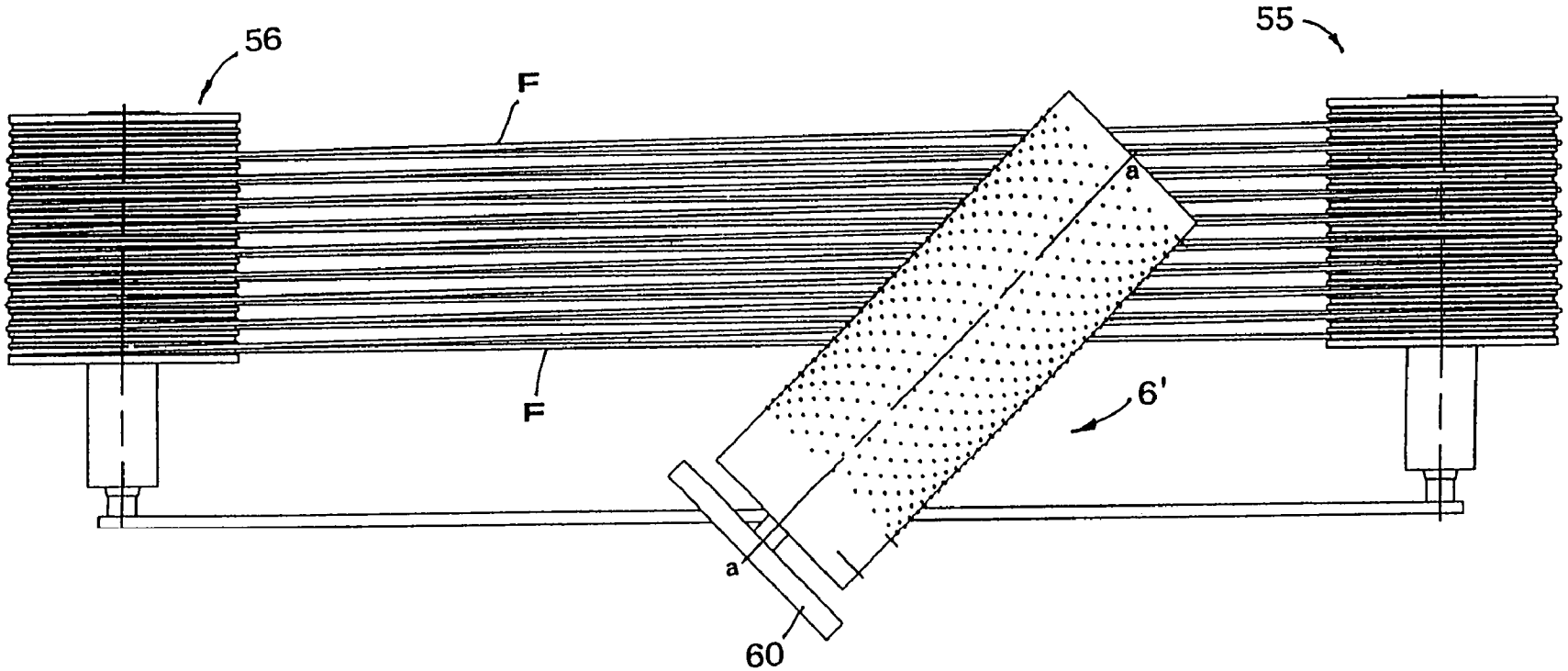

In place of, or in association with the brushes, other abrasive means may be used, such as those of the type illustrated in FIG. 4, wherein these means are made up of a cylinder 6' coated with diamond or emery paper to achieve an even more different effect.

Advantageously, the surface speed of brushes 6 (or of cylinders 6') is higher than the feed speed of the thread under treatment.

As best visible in FIGS. 3 and 4, the position of the longitudinal axis a—a of the brush(es) 6 (or of other abrasive means such as the cylinder 6' of FIG. 4) may be changed, starting from the vertical position (so as to form an angle of substantially 90° to the thread) up to the horizontal (that is, with the axis a-a parallel to the thread). The positioning of the brushes on different orientations can be obtained by engaging the brushes-supporting base 60, that is, the relevant driving shaft, with means which are apt to fix the orientation thereof in a stable but removable manner. For example, as exemplified in FIG. 6, the assembly of motor 69, shaft 68, support 60 and quick coupling mount 66, may be supported by a bracket 62 whose orientation can be changed. In the same way, the brush 6 can be moved closer to or away from the thread F, by disposing the support 60 onto a base movable relative to the plane P of the apparatus 1 in order to correspondingly vary the interaction between the thread and the bristles of the brush.

With different orientations of the brushes, as well as by means of a more or less interaction, it is possible to obtain different effects of abrasion on the thread. The change in the orientation can be automated and/or suitably timed to favour a constant wear of the bristles of brushes 6. Data relating to the orientation of the brushes may also be stored and used by the computer above described.

The brushes 6, and the cylinders 6' as well, can be made to act on the thread with random frequency so as to give it non-repetitive, bright/dull effects. The operation of the abrasive means can be controlled by a software program with an algorithm generating random periods of interventions and relevant lengths thereof.

Figure 6:
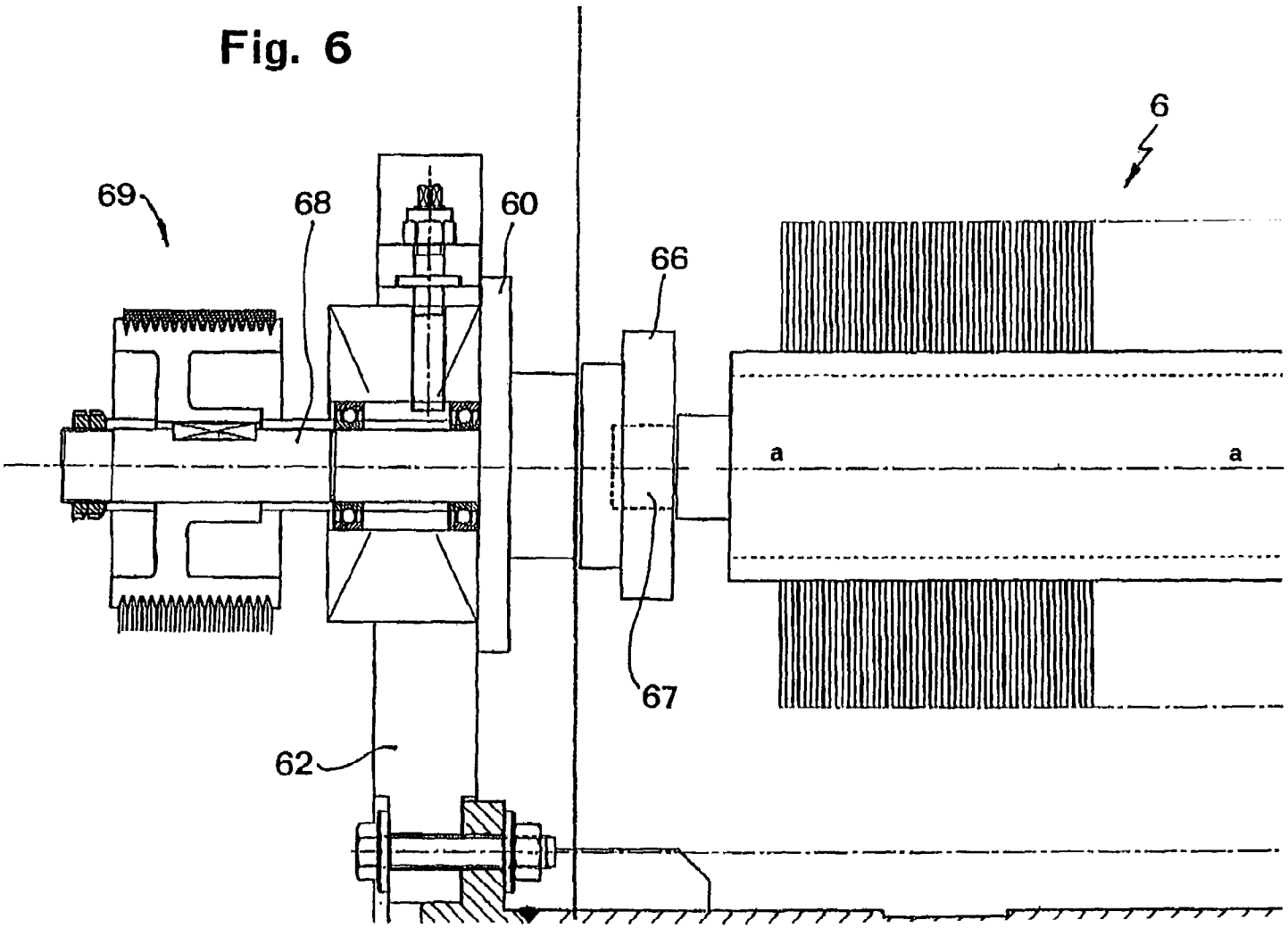
FIG. 6 is a side partial view, with parts in section, of a detail relating to means for driving and supporting the abrasive means.

Shown in FIG. 6 is a brush 6 provided with an attachment 67 complementarily matchable with a coupling seat 66 formed in the driving motor 68 of the brush. This makes it possible to quickly replace the brush and set up the machine according to the material to be worked. Moreover, the shaft 68, which receives the motion from a relevant motor 69, can be oriented as described above.

The means for driving, controlling and checking the elements above described and illustrated in the accompanying drawings are of a type known to those skilled in the art and have not therefore been described in greater detail, for the sake of simplicity. The construction details may vary in any equivalent way as far as the shape, dimensions, elements disposition, nature of the used materials are concerned, without nevertheless departing from the scope of the adopted solution idea and, thereby, remaining within the limits of the protection granted to the present patent.

What is claimed is:

1. A process for the mechanical transformation of a thread that includes the steps of:

providing and apparatus for the mechanical transformation of such thread, the apparatus including two supports;

receiving and returning the thread by one of said supports to other of said supports at least three times to sustain the thread by defining a suspended length;

providing an abrasive device disposed and acting in correspondence of the suspended length; and using the apparatus for the mechanical transformation of the thread for abrading the thread when the thread is supported in the air between said two supports, wherein the thread winds up said supports through a set of several passages around said supports.

2. The process of claim 1, wherein the thread is continuously fed between said supports while operating said abrading step throughout the process.

3. The process of claim 1, wherein two cylinders are used for supporting the thread, at least one of said two cylinders being slotted with a corresponding number of slots to guide the thread and to keep the distance among the various portions of the passages itself constant.

4. The process of claim 1, said apparatus further including a tension sensor to detect a thread tension, wherein the thread is unwound from a bobbin by a motor means driving a pull unit to pull the thread, and the tension of the thread as it unwinds is detected in order to drive and control said motor means on the basis of a detected tension value to provide a uniform abraded effect on the thread by keeping said thread tension steady during said abraiding step.

5. The process of claim 4, wherein said bobbin is supported on a shaft driven by a second motor means and wherein said second motor means is driven on the basis of said detected value of the thread's tension.

6. The process of claim 1, wherein said abraiding step is operated by moving said abrasive device closer to the thread, whose position relative to the same thread can be made to vary in relation to an orientation and/or distance values.

7. The process of claim 1, wherein said abrading step is operated by moving said abrasive device closer to the thread, said abrasive device having different abrasive capacity.

8. The process of claim 1, wherein said abrading step is operated by moving said abrasive device closer to the thread at various times with intervals randomly differentiated from each other.

9. The process of claim 2, wherein said abrading step is operated with an abrasive means having a substantially cylindrical shape rotating about its own axis with a surface speed higher than that for the feeding of the thread.

10. An apparatus for the mechanical transformation of a thread, the apparatus comprising:

a suspending means including a support and another support designed to receive and return the thread to one another at least three times and to be able to sustain the thread by defining a suspended length; and abrasive means disposed and acting in correspondence of said suspended length, wherein the thread winds up said supports through a set of several passages around said supports.

11. The process of claim 10, wherein the apparatus further comprises motor means for unreeling the thread from a bobbin and sensor means for detecting the tension of the thread connected to said motor means.

12. The process of claim 10, wherein said abrasive means comprises of one or more brushes.

13. The process of claim 10, wherein said abrasive means comprises of one or more brushes provided along respective longitudinal axes, said brushes on which a set of bristles are disposed on staves spaced apart and parallel to longitudinal axes of said brushes.

14. The process of claim 12, wherein a set of bristles of said brushes are made from abrasive nylon.

15. The process of claim 13, wherein said bristles of said brushes are made from abrasive nylon.

16. The process of claim 10, wherein said abrasive means comprises of one or more cylinders coated with diamond or emery paper.

17. The process of claim 10, wherein said abrasive means are disposed on supports whose positions relative to the thread can be made to vary in relation to an orientation and/or distance values.

18. An apparatus according to claim 10, further comprising:

a tension sensor supporting the thread at a location before or after said suspending means to detect a tension of the thread; and a motor means driving a pull unit to pull the thread unwound from a bobbin, an operation of said motor means being dependent on said tension to keep said tension steady while driving said pull unit.

19. An apparatus according to claim 18, wherein said bobbin is supported on a shaft driven by another motor means being depending on said tension.

* * * * *